US008913094B2

(12) United States Patent
Chu Ke et al.

(10) Patent No.: US 8,913,094 B2
(45) Date of Patent: Dec. 16, 2014

(54) DISPLAY AND METHOD OF DISPLAYING AN IMAGE WITH A PIXEL

(71) Applicant: AU Optronics Corp., Hsin-Chu (TW)

(72) Inventors: Hui Chu Ke, Hsin-Chu (TW); Sheng-Wen Cheng, Hsin-Chu (TW); Wei-Chieh Sun, Hsin-Chu (TW); Ming-Sheng Lai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 178 days.

(21) Appl. No.: 13/714,432

(22) Filed: Dec. 14, 2012

(65) Prior Publication Data

US 2014/0035970 A1 Feb. 6, 2014

(30) Foreign Application Priority Data

Aug. 1, 2012 (TW) ..... 101127738 A

(51) Int. Cl.
*G09G 5/10* (2006.01)
*G09G 3/36* (2006.01)
*G09G 3/32* (2006.01)

(52) U.S. Cl.
CPC ..... *G09G 3/32* (2013.01); *G09G 2320/0242* (2013.01); *G09G 2340/06* (2013.01)
USPC ..... 345/690; 345/87; 345/88; 345/89

(58) Field of Classification Search
CPC ..... G09G 2340/06; G09G 2320/0242; G09G 5/02; G09G 3/3607
USPC ..... 345/690, 87–89
See application file for complete search history.

(56) References Cited

U.S. PATENT DOCUMENTS

| | | | | |
|---|---|---|---|---|
| 6,897,876 | B2 * | 5/2005 | Murdoch et al. | 345/589 |
| 8,049,763 | B2 | 11/2011 | Kwak et al. | |
| 8,232,944 | B2 * | 7/2012 | Takada et al. | 345/88 |
| 2009/0207182 | A1 | 8/2009 | Takada et al. | |
| 2009/0278867 | A1 * | 11/2009 | Brown et al. | 345/690 |

FOREIGN PATENT DOCUMENTS

CN 101370148 A 2/2009

OTHER PUBLICATIONS

Lee, " 40.5L: Late-News Paper: TFT-LCD with RGBW Color System", SID, http://onlinelibrary.wiley.com/doi/10.1889/1.1832505/abstract, May 2003.

* cited by examiner

*Primary Examiner* — Ilana Spar
(74) *Attorney, Agent, or Firm* — Winston Hsu; Scott Margo

(57) ABSTRACT

A pixel includes four sub-pixels. The pixel is used to receive a plurality of signal values to display an image. The signal values are N-bit signal values, and the largest value of the signal values is $(2^N-1)$. The method of displaying the image with the pixel includes providing three color signals, generating four transformation signals corresponding to the four sub-pixels according to the values of the three color signals, and using four output signals to display the image of the pixel when the color saturation value is not larger than a first predetermined value and a fourth transformation signal of the four transformation signals is larger than other three transformation signals of the four transformation signals.

20 Claims, 3 Drawing Sheets

DISPLAY AND METHOD OF DISPLAYING AN IMAGE WITH A PIXEL

BACKGROUND

1. Technical Field

The document relates to a display device and a method of displaying an image of a pixel, especially a method of transforming image data of the signal values corresponding to the three primary colors into image data of the signal values corresponding to the three primary colors and the white color.

2. Description of the Prior Art

Liquid crystal displays (LCDs) and light emitting diode (LED) displays are widely used nowadays. Because liquid crystal displays and LED displays have slim shapes, low power dissipation and low radiation, liquid crystal displays and LED displays gradually replace traditional CRT (cathode ray tube) monitors and are widely used in mobile electronic devices such as notebooks and PDAs (personal digital assistants).

Compared to LCDs, organic light emitting diode (OLED) displays are capable of self-emitting light and have wider viewing angles, higher contrast, lower operating voltages, faster dynamic response, brighter colors, simpler manufacturing processes and thinner thickness, thus they are gradually replacing LCDs. In OLED display manufacturing procedures, a bias voltage is applied to an OLED, to make the inner electrons and electric holes pass through the hole transport layer and the electron transport layer, then an organic material capable of emitting light is added to the OLED. Afterwards excitons will be formed, energy will be released and excitons will return to the ground state. The energy can be released in various colored light, and the color is determined by the characteristic of selected organic materials.

The prior OLED displays are usually equipped with light emitting elements of red, green and blue colors to display high luminance and high chrominance images. However, the lifespan of red, green and blue light emitting elements is different, causing the displays to display incorrect colors due to the attenuation of the light emitting elements.

To solve the above issue, white OLEDs formed with RGB color filters have been developed. However, the RGB color filters will reduce the penetration rate of the display. To solve this problem, four color OLEDs with color filters of red, green, blue and white have been proposed. The prior four color OLEDs utilize the high penetration rate of white color to enhance the luminance of the display. But images displayed by the four color OLEDs still have color distortion, and power dissipation can not be effectively reduced.

SUMMARY

An embodiment of the present disclosure relates to a method of displaying an image of a pixel. The pixel comprises a first sub-pixel, a second sub-pixel, a third sub-pixel and a fourth sub-pixel. The pixel is used to receive a plurality of N-bit signal values to display the image. A largest value of each of the signal values is $(2^N-1)$. The method comprises providing a first signal, a second signal and a third signal; transforming the first signal, the second signal and the third signal into a first output signal, a second output signal, a third output signal and a fourth output signal; and using the first output signal, the second output signal, the third output signal and the fourth output signal to display images corresponding to the first sub-pixel, the second sub-pixel, the third sub-pixel and the fourth sub-pixel respectively so as to form the image of the pixel. When a color saturation value is not larger than a first predetermined value, the fourth output signal is not smaller than the first output signal, the second output signal and the third output signal. N is a positive integer.

Another embodiment of the present disclosure relates to a display. The display comprises a plurality of pixels, a signal providing device, a color saturation value generating device, a signal transforming device and a display panel. Each of the plurality of pixels comprises a first sub-pixel, a second sub-pixel, a third sub-pixel and a fourth sub-pixel, the pixel being used for receiving a plurality of signal values to display images, wherein the signal values are N-bit signal values, and a largest value of the signal values is $(2^N-1)$. The signal providing device is for providing a first signal, a second signal and a third signal. The color saturation value generating device is for generating a color saturation value corresponding to the first signal, the second signal and the third signal. The signal transforming device is for transforming the first signal, the second signal and the third signal into the first output signal, the second output signal, the third output signal and the fourth output signal when the color saturation value is substantially not larger than a predetermined value. The display panel is for using the first output signal, the second output signal, the third output signal and the fourth output signal to display images corresponding to the first sub-pixel, the second sub-pixel, the third sub-pixel and the fourth sub-pixel respectively so as to form images of the pixel, wherein the fourth output signal is not smaller than the first output signal, the second output signal and the third output signal, and N is a positive integer.

These and other objectives of the present invention will no doubt become obvious to those of ordinary skill in the art after reading the following detailed description of the preferred embodiment that is illustrated in the various figures and drawings.

DETAILED DESCRIPTION

Some phrases are referred to specific elements in the present specification and claims, please notice that the manufacturer might use different terms to refer to the same elements. However, the definition between elements is based on their functions instead of their names. Further, in the present specification and claims, the term "comprising" is open type and should not be viewed as the term "consisted of."

The embodiments and figures are provided as follows in order to illustrate the present invention in detail, but the claimed scope of the present invention is not limited by the provided embodiments and figures.

Figure 1:
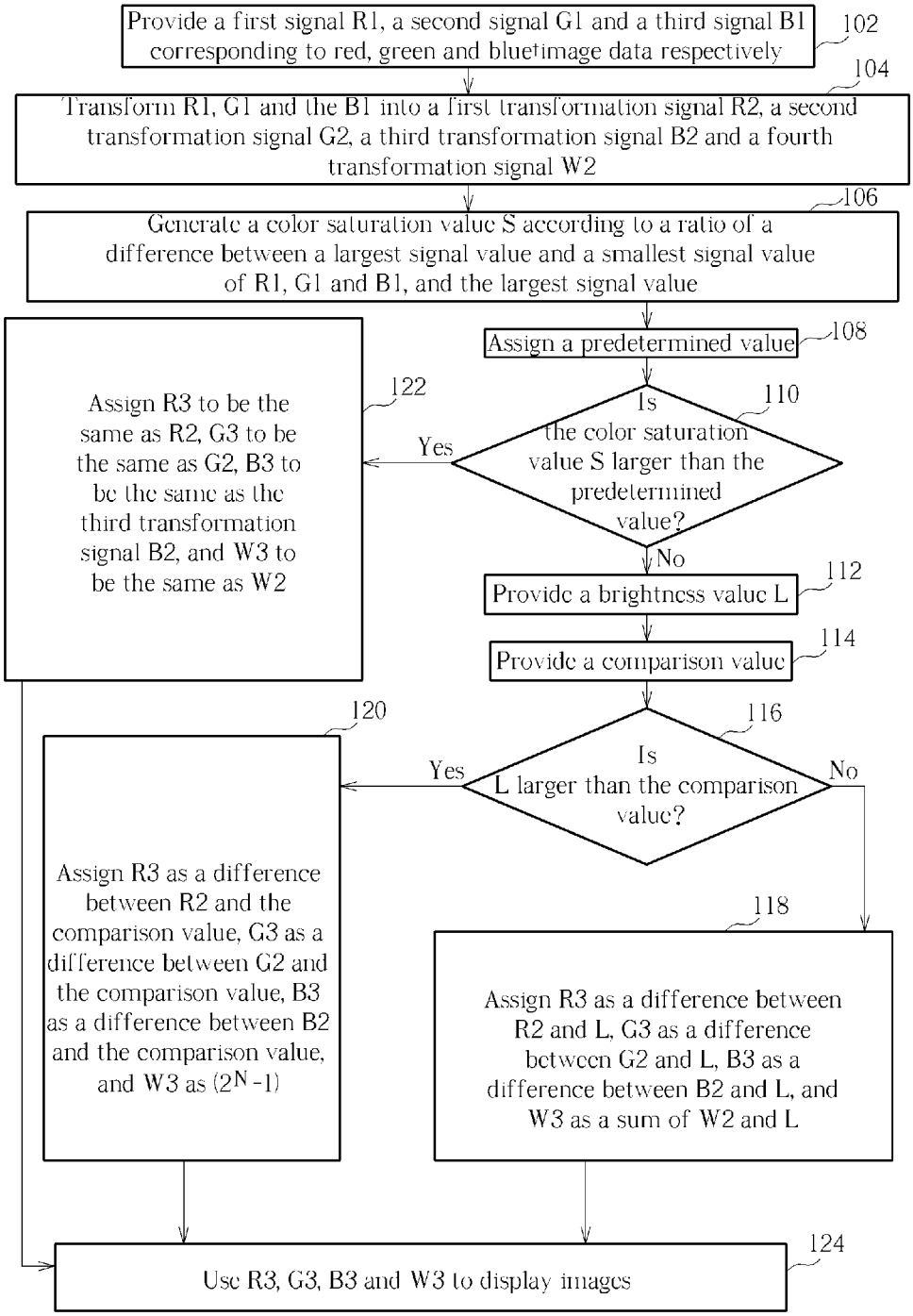
FIG. 1 shows a flowchart of a display using a pixel to display an image according to a first embodiment of the present invention.

Please refer to FIG. 1, which shows a flowchart of a display using a pixel to display an image according to a first embodiment of the present invention. The display mentioned in the present invention is a four color display. Each pixel of the display comprises a first sub-pixel, a second sub-pixel, a third sub-pixel and a fourth sub-pixel. For example, the first sub-pixel, the second sub-pixel, the third sub-pixel and the fourth sub-pixel can be red, green, blue (the three primary colors)

and white (or transparent) sub-pixels, but not limited to those colors. The pixel can be used to receive a plurality of signal values, and to display an image according to the received signal values. The signal values herein can be the grey levels of the display, and are N-bit signal values. The largest signal value of each of the signal values is $(2^N-1)$. For example, in an 8-bit display, the grey level thereof is from 0 to 255. N is a positive integer. The descriptions of the flowchart in FIG. 1 are as follows:

Step 102: provide a first signal R1, a second signal G1 and a third signal B1 corresponding to red, green and blue (or other three colors) image data respectively;

Step 104: transform the first signal R1, the second signal G1 and the third signal B1 provided in Step 102 into a first transformation signal R2, a second transformation signal G2, a third transformation signal B2 and a fourth transformation signal W2;

Step 106: generate a color saturation value S according to a ratio of a difference between a largest signal value and a smallest signal value of the first signal R1, the second signal G1 and the third signal B1 provided in Step 102, and the largest signal value.

Step 108: assign a predetermined value;

Step 110: compare the color saturation value S generated in Step 106 with the predetermined value provided in Step 108; if the color saturation value S is not larger than the predetermined value, perform Step 112; if the color saturation value S is larger than the predetermined value, perform Step 122;

Step 112: provide a brightness value L, the brightness value L is a smallest value of the first transformation signal R2, the second transformation signal G2, and the third transformation signal B2;

Step 114: provide a comparison value, the comparison value is a difference between the fourth transformation signal W2 and $(2^N-1)$;

Step 116: compare the brightness value L with the comparison value provided in Step 114; if the brightness value L is not larger than the comparison value, perform Step 118; if the brightness value L is larger than the comparison value, perform Step 120;

Step 118: assign the first output signal R3 as a difference between the first transformation signal R2 and the brightness value L, the second output signal G3 as a difference between the second transformation signal G2 and the brightness value L, the third output signal B3 as a difference between the third transformation signal B2 and the brightness value L, and the fourth output signal W3 as a sum of the fourth transformation signal W2 and the brightness value L. When the color saturation value S is not larger than the predetermined value, the fourth output signal W3 is not smaller than the first output signal R3, the second output signal G3 and the third output signal B3, and then perform Step 124;

Step 120: assign the first output signal R3 as a difference between the first transformation signal R2 and the comparison value, the second output signal G3 as a difference between the second transformation signal G2 and the comparison value, the third output signal B3 as a difference between the third transformation signal B2 and the comparison value, and the fourth output signal W3 as $(2^N-1)$. The fourth output signal W3 is not smaller than the first output signal R3, the second output signal G3 and the third output signal B3, and then perform Step 124;

Step 122: assign the value of the first output signal R3 to be the same as the value of the first transformation signal R2, the value of the second output signal G3 to be the same as the value of the second transformation signal G2, the value of the third output signal B3 to be the same as the value of the third transformation signal B2, and the value of the fourth output signal W3 to be the same as the value of the fourth transformation signal W2;

Step 124: use the first output signal R3, the second output signal G3, the third output signal B3 and the fourth output signal W3 to display images corresponding to the first sub-pixel, the second sub-pixel, the third sub-pixel and the fourth sub-pixel respectively so as to form the image of the pixel of the display.

In Step 104, transforming the first signal R1, the second signal G1 and the third signal B1 to the first transformation signal R2, the second transformation signal G2, a third transformation signal B2 and a fourth transformation signal W2 can be implemented with the following equations (1) to (4), but is not limited to equations (1) to (4).

$$W2 = \min[R1, G1, B1] \tag{1}$$

$$R2 = \left\{\left[1 + \left(\frac{W2}{\max[R1, G1, B1]}\right)\right] \times R1\right\} - W2 \tag{2}$$

$$G2 = \left\{\left[1 + \left(\frac{W2}{\max[R1, G1, B1]}\right)\right] \times G1\right\} - W2 \tag{3}$$

$$B2 = \left\{\left[1 + \left(\frac{W2}{\max[R1, G1, B1]}\right)\right] \times B1\right\} - W2 \tag{4}$$

In the above equations, max[R1,G1,B1] denotes the largest signal of the first signal R1, the second signal G1 and the third signal B1, and min[R1,G1,B1] denotes the smallest signal of the first signal R1, the second signal G1 and the third signal B1. In Step 106, the color saturation value can be calculated with the following equation (5):

$$S = \frac{\max[R1, G1, B1] - \min[R1, G1, B1]}{\max[R1, G1, B1]} \tag{5}$$

The aforementioned color saturation value S and signal values can be calculated in the grey level domain or in the gamma domain, and in the first embodiment, the color saturation value S and signal values are calculated in the grey level domain. In Steps 108 and 110, consider that the power saving efficiencies under different color saturation values S are different, Step 112 or 122 is performed according to whether the color saturation value S exceeds the predetermined value 0.25 or not so as to optimize power saving of the display.

In Steps 118 and 120, the first transformation signal R2, the second transformation signal G2 and the third transformation signal B2 and the fourth transformation signal W2 are transformed into the first output signal R3, the second output signal G3, the third output signal B3 and the fourth signal W3. When the color saturation value S is not larger than the predetermined value, the fourth output signal W3 will not be smaller than the first output signal R3, the second output signal G3 and the third output signal B3. Similarly, in Steps 116, 118 and 120, to improve the power saving, the first transformation signal R2, the second transformation signal G2, the third transformation signal B2 and the fourth transformation signal W2 are transformed into the first output signal R3, the second output signal G3, the third output signal B3 and the fourth signal W3 according to the comparison result of the brightness value L and the comparison value. The brightness value L can be generated according to the following equation (6), and Steps 118 and 120 are generated according to the following equations (7) and (8):

$$L=\min[R2,G2,B2] \quad (6)$$

$$\text{If } L\leq[(2^n-1)-W2],\text{then}[R3,G3,B3,W3]=[R2-L,G2-L,B2-L,W2+L] \quad (7)$$

$$\text{If } L>[(2^n-1)-W2],\text{then}[R3,G3,B3,W3]=[R2-[(2^n-1-L],G2-[(2^n-1-L)],B2-[(2^n-1-L)],(2^n-1)] \quad (8)$$

Besides, in the first embodiment, the predetermined value of the present invention is not limited to be 0.25. Step 122 is performed when the color saturation value exceeds 0.25 or another predetermined value. That is, when the color saturation value S is larger than the predetermined value, the first output signal R3, the second output signal G3, the third output signal B3 and the fourth signal W3 are not necessary assigned to be the first transformation signal R2, the second transformation signal G2 and the third transformation signal B2 and the fourth transformation signal W2. They can be assigned to be other values. Further, the comparison value of the present invention is not limited to be the difference between the fourth transformation signal W2 and $(2^N-1)$.

Through the configurations in the first embodiment, the signal values corresponding to red, green and blue colors are transformed to the signal values corresponding to red, green, blue and white colors, thus raising the grey levels of the signal values corresponding to the white color, and reducing the grey levels of the signal values corresponding to the red, green and blue colors to save power. In general, the light emitting efficiency of a white sub-pixel is higher than that of sub-pixels in other colors. However, signal values should be calculated according to the magnitude of the color saturation value S to further optimize power saving of the display. Moreover, the adjusted image data should retain the colors of the original image data while reducing power consumption.

Figure 2:
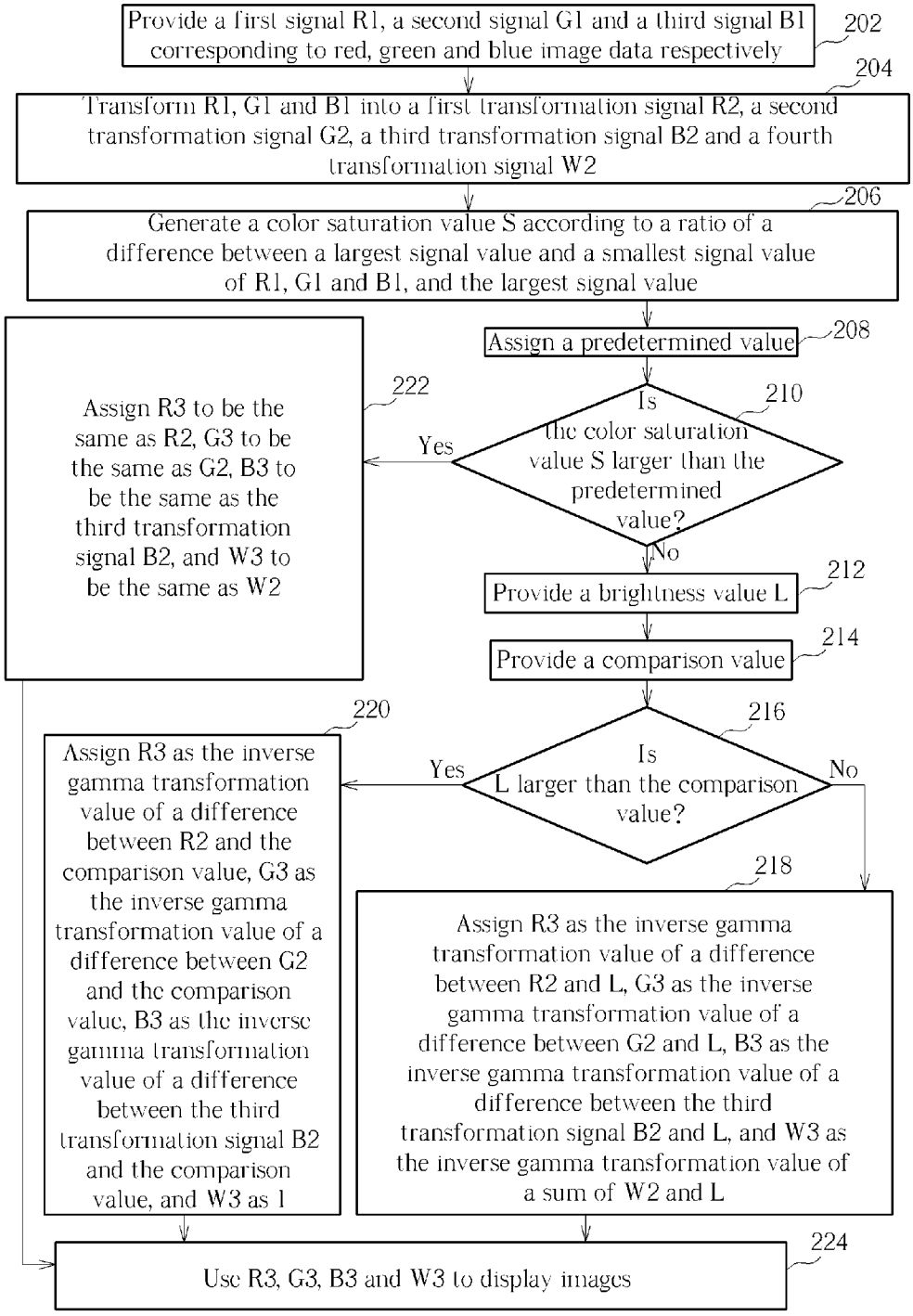
FIG. 2 shows a flowchart of a display using a pixel to display an image according to a second embodiment of the present invention.

Please refer to FIG. 2, which shows a flowchart of a display using a pixel to display an image according to a second embodiment of the present invention. The difference between the first and second embodiments is that in the second embodiment, the operations of signal values are performed in the gamma domain. In the gamma domain, the brightness of 1 presents the largest brightness, and can be converted to $(2^N-1)$ in the grey level domain. The descriptions of the flowchart in FIG. 2 are as follows:

Step 202: provide a first signal R1, a second signal G1 and a third signal B1 corresponding to red, green and blue (or other three colors) image data respectively;

Step 204: transform the first signal R1, the second signal G1 and the third signal B1 provided in Step 202 into a first transformation signal R2, a second transformation signal G2, a third transformation signal B2 and a fourth transformation signal W2;

Step 206: generate a color saturation value S according to a ratio of a difference between a largest signal value and a smallest signal value of the first signal R1, the second signal G1 and the third signal B1 provided in Step 202, and the largest signal value.

Step 208: assign a predetermined value;

Step 210: compare the color saturation value S generated in Step 206 with the predetermined value provided in Step 208; if the color saturation value S is not larger than the predetermined value, perform Step 212; if the color saturation value S is larger than the predetermined value, perform Step 222;

Step 212: provide a brightness value L, the brightness value L is the gamma transformation value of a smallest value of the first transformation signal R2, the second transformation signal G2, and the third transformation signal B2;

Step 214: provide a comparison value, the comparison value is the gamma transformation value of a difference between the fourth transformation signal W2 and 1;

Step 216: compare the brightness value L with the comparison value provided in Step 214; if the brightness value L is not larger than the comparison value, perform Step 218; if the brightness value L is larger than the comparison value, perform Step 220;

Step 218: assign the first output signal R3 as the inverse gamma transformation value of a difference between the first transformation signal R2 and the brightness value L, the second output signal G3 as the inverse gamma transformation value of a difference between the second transformation signal G2 and the brightness value L, the third output signal B3 as the inverse gamma transformation value of a difference between the third transformation signal B2 and the brightness value L, and the fourth output signal W3 as the inverse gamma transformation value of a sum of the fourth transformation signal W2 and the brightness value L. When the color saturation value S is not larger than the predetermined value, the fourth output signal W3 is not smaller than the first output signal R3, the second output signal G3 and the third output signal B3, and then perform Step 224;

Step 220: assign the first output signal R3 as the inverse gamma transformation value of a difference between the first transformation signal R2 and the comparison value, the second output signal G3 as the inverse gamma transformation value of a difference between the second transformation signal G2 and the comparison value, the third output signal B3 as the inverse gamma transformation value of a difference between the third transformation signal B2 and the comparison value, and the fourth output signal W3 as 1. The fourth output signal W3 is not smaller than the first output signal R3, the second output signal G3 and the third output signal B3, and then perform Step 124;

Step 222: assign the value of the first output signal R3 to be the same as the value of the first transformation signal R2, the value of the second output signal G3 to be the same as the value of the second transformation signal G2, the value of the third output signal B3 to be the same as the value of the third transformation signal B2, and the value of the fourth output signal W3 to be the same as the value of the fourth transformation signal W2;

Step 224: use the first output signal R3, the second output signal G3, the third output signal B3 and the fourth output signal W3 to display images corresponding to the first sub-pixel, the second sub-pixel, the third sub-pixel and the fourth sub-pixel respectively so as to form the image of the pixel of the display.

For example, the gamma transformation can be implemented with the following equation (9). In equation (9), W denotes the grey level of a white sub-pixel, w denotes the brightness value of the white sub-pixel, γ denotes a gamma value of the white sub-pixel $$w=\left(\frac{W}{2^N-1}\right)^{\gamma} \quad (9)$$

Similarly, through the configuration in the second embodiment, the signal values corresponding to red, green and blue colors are transformed to the signal values corresponding to red, green, blue and white colors, thus raising the grey levels of the signal values corresponding to the white color, and reducing the grey levels of the signal values corresponding to the red, green and blue colors to save power. In general, the light emitting efficiency of a white sub-pixel is higher than that of sub-pixels in other colors. However, signal values should be calculated according to the magnitude of the color saturation value S to further optimize power saving of the display. Moreover, the adjusted image data should retain the colors of the original image data while reducing power consumption.

Figure 3:
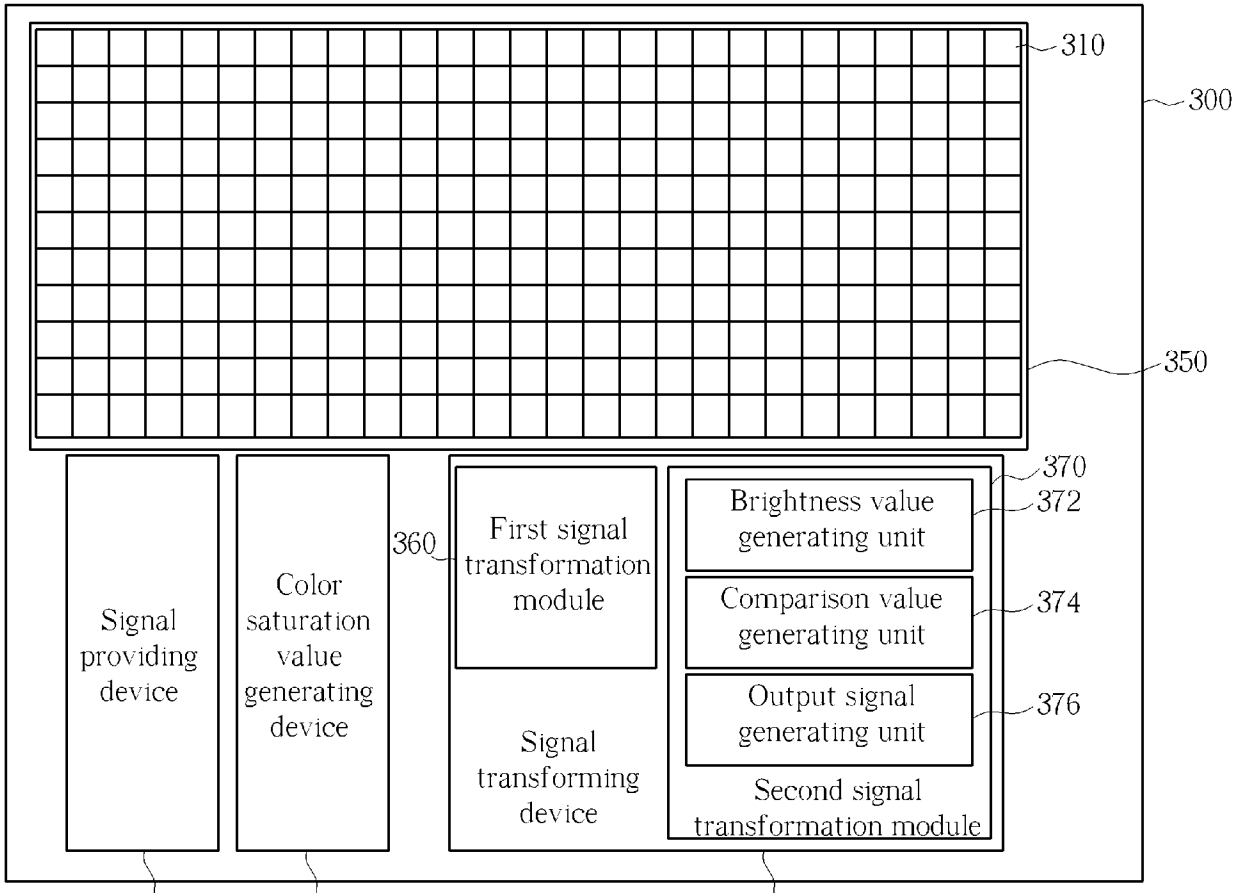
FIG. 3 shows a display according to a third embodiment of the present invention.

Please refer to FIG. 3, which shows a display 300 according to a third embodiment of the present invention. The display 300 can be implemented by applying Steps 102 to 124 or Steps 202 to 224. As shown in FIG. 3, the display 300 comprises a plurality of pixels 310, a signal providing device 320, a color saturation value generating device 330, a signal transforming device 340 and the display panel 350. Each pixel 30 comprises a first sub-pixel, a second sub-pixel, a third sub-pixel and a fourth sub-pixel. The first sub-pixel, second sub-pixel, third sub-pixel and fourth sub-pixel can be sub-pixels corresponding to red, green, blue and white colors respectively, or corresponding to other colors. The pixel 310 is used to receive a plurality of signal values to display images. The signal values to be received are N-bit, and the largest signal value is $(2^N-1)$. The signal providing device 320 is used to provide a first signal R1, a second signal G1 and a third signal B1. The color saturation value generating device 330 is used to generate a color saturation value S corresponding to the first signal R1, the second signal G1 and the third signal B1. The signal transforming device 340 is used to transform the first signal R1, the second signal G1 and the third signal B1 into the first output signal R3, the second output signal G3, the third output signal B3 and the fourth output signal W3 when the color saturation value is not larger than the predetermined value. The predetermined value can be 0.25. The display panel 350 is used for using the first output signal R3, the second output signal G3, the third output signal B3 and the fourth output signal W3 to display images corresponding to the first sub-pixel, the second sub-pixel, the third sub-pixel and the fourth sub-pixel respectively so as to form the image of the pixel. The fourth output signal W3 is not smaller than the first output signal R3, the second output signal G3 and the third output signal B3.

The signal transforming device 340 comprises a first signal transformation module 360 and a second signal transformation module 370. The first signal transformation module 360 is used to generate a first transformation signal R2, a second transformation signal G2, a third transformation signal B2 and a fourth transformation signal W2 according to the first signal R1, the second signal G1 and the third signal B1. The second signal transformation module 370 is used to transform the first transformation signal R2, second transformation signal G2, third transformation signal B2 and fourth transformation signal W2 into the first output signal R3, the second output signal G3, the third output signal B3 and the fourth output signal W3. Besides, the second signal transformation module 370 comprises a brightness value generating unit 372, a comparison value generating unit 374 and an output signal generating unit 376. The brightness generating unit 372 is used to provide a brightness value L. The brightness value L is the smallest value of the first transformation signal R1, the second transformation signal G1 and the third transformation signal B1. The comparison value generating unit 374 is used to provide a comparison value in the grey level domain or in the gamma domain. In the grey level domain, the comparison value is the difference between the fourth transformation signal and $(2^N-1)$. In the gamma domain, the comparison value is the difference between the fourth transformation signal and 1. The output signal generating unit 376 is used to assign the first output signal R3 as a difference between the first transformation signal R2 and the brightness value L, the second output signal G3 as a difference between the second transformation signal G2 and the brightness value L, the third output signal B3 as a difference between the third transformation signal B2 and the brightness value L, and the fourth output signal W3 as a sum of the fourth transformation signal W2 and the brightness value L when the brightness value L is not larger than the comparison value.

The approaches to generate transformation signals, output signals and color saturation signals and to calculate and compute the brightness value L and the comparison value are illustrated in the first embodiment, and will not be further described. Similarly, through the configuration in the third embodiment, the signal values corresponding to red, green and blue colors are transformed to the signal values corresponding to red, green, blue and white colors, thus raising the grey levels of the signal values corresponding to the white color, and reducing the grey levels of the signal values corresponding to the red, green and blue colors to save power. In general, the light emitting efficiency of a white sub-pixel is higher than that of sub-pixels in other colors. However, signal values should be calculated according to the magnitude of the color saturation value S to optimize power saving of the display. Moreover, the adjusted image data should retain the colors of the original image data while reducing power consumption.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of displaying an image of a pixel, the pixel comprising a first sub-pixel, a second sub-pixel, a third sub-pixel and a fourth sub-pixel, the pixel receiving a plurality of N-bit signal values to display the image, a largest value of each of the signal values being $(2^N-1)$, the method comprising:

providing a first signal, a second signal and a third signal;

transforming the first signal, the second signal and the third signal into a first output signal, a second output signal, a third output signal and a fourth output signal, wherein when a color saturation value is substantially not larger than a first predetermined value, the fourth output signal is substantially not smaller than the first output signal, the second output signal and the third output signal; and using the first output signal, the second output signal, the third output signal and the fourth output signal to display images corresponding to the first sub-pixel, the second sub-pixel, the third sub-pixel and the fourth sub-pixel respectively so as to form the image of the pixel;

wherein N is a positive integer.

2. The method of claim 1, wherein the first predetermined value is 0.25.

3. The method of claim 1, wherein transforming the first signal, the second signal and the third signal into the first output signal, the second output signal, the third output signal and the fourth output signal comprises:

generating a first transformation signal, a second transformation signal, a third transformation signal and a fourth transformation signal according to the first signal, the second signal and the third signal; and if the color saturation value is substantially not larger than the first predetermined value, transforming the first transformation signal, the second transformation signal, the third transformation signal and the fourth transformation signal into the first output signal, the second output signal, the third output signal and the fourth output signal.

4. The method of claim 3, wherein the color saturation value is generated according to a ratio of a difference between a largest signal value and a smallest signal value of the first signal, the second signal and the third signal, and the largest signal value.

5. The method of claim 3, wherein transforming the first transformation signal, the second transformation signal, the third transformation signal and the fourth transformation signal into the first output signal, the second output signal, the third output signal and the fourth output signal comprises:

providing a brightness value, the brightness value being a smallest value of the first transformation signal, the second transformation signal, and the third transformation signal;

providing a comparison value, the comparison value being a difference between the fourth transformation signal and $(2^N-1)$; and if the brightness value is substantially not larger than the comparison value, the first output signal being a difference between the first transformation signal and the brightness value, the second output signal being a difference between the second transformation signal and the brightness value, the third output signal being a difference between the third transformation signal and the brightness value, the fourth output signal being a sum of the fourth transformation signal and the brightness value.

6. The method of claim 3, wherein transforming the first transformation signal, the second transformation signal, the third transformation signal and the fourth transformation signal into the first output signal, the second output signal, the third output signal and the fourth output signal comprises:

providing a brightness value, the brightness value being a smallest value of the first transformation signal, the second transformation signal, and the third transformation signal;

providing a comparison value, the comparison value being a difference between the fourth transformation signal and $(2^N-1)$; and if the brightness value is substantially larger than the comparison value, the first output signal being a difference between the first transformation signal and the comparison value, the second output signal being a difference between the second transformation signal and the comparison value, the third output signal being a difference between the third transformation signal and the comparison value, the fourth output signal being $(2^N-1)$.

7. The method of claim 3, wherein transforming the first transformation signal, the second transformation signal, the third transformation signal and the fourth transformation signal into the first output signal, the second output signal, the third output signal and the fourth output signal comprises:

providing a brightness value, the brightness value being a gamma transformation signal of a smallest value of the first transformation signal, the second transformation signal, and the third transformation signal;

providing a comparison value, the comparison value being a difference between a gamma transformation signal of the fourth transformation signal and 1; and if the brightness value is substantially not larger than the comparison value, the first output signal being an inverse gamma transformation signal of a difference between a gamma transformation signal of the first transformation signal and the brightness value, the second output signal being an inverse gamma transformation signal of a difference between a gamma transformation signal of the second transformation signal and the brightness value, the third output signal being an inverse gamma transformation signal of a difference between a gamma transformation signal of the third transformation signal and the brightness value, the fourth output signal being an inverse gamma transformation signal of a sum of a gamma transformation signal of the fourth transformation signal and the brightness value.

8. The method of claim 7, wherein the gamma transformation signal of the fourth transformation signal is:

$$w = \left(\frac{W}{2^N - 1}\right)^{\gamma};$$

wherein w denotes the gamma transformation signal of the fourth transformation signal, W denotes the fourth transformation signal, and γ denotes a gamma value of the pixel.

9. The method of claim 3, wherein transforming the first transformation signal, the second transformation signal, the third transformation signal and the fourth transformation signal into the first output signal, the second output signal, the third output signal and the fourth output signal comprises:

providing a brightness value, the brightness value being a gamma transformation signal of a smallest value of the first transformation signal, the second transformation signal, and the third transformation signal;

providing a comparison value, the comparison value being a difference between a gamma transformation signal of the fourth transformation signal and 1; and if the brightness value is substantially larger than the comparison value, the first output signal being an inverse gamma transformation signal of a difference between a gamma transformation signal of the first transformation signal and the comparison value, the second output signal being an inverse gamma transformation signal of a difference between a gamma transformation signal of the second transformation signal and the comparison value, the third output signal being an inverse gamma transformation signal of a difference between a gamma transformation signal of the third transformation signal and the comparison value, and the fourth output signal being 1.

10. The method of claim 9, wherein the gamma transformation signal of the fourth transformation signal is:

$$w = \left(\frac{W}{2^N - 1}\right)^{\gamma};$$

wherein w denotes the gamma transformation signal of the fourth transformation signal, W denotes the fourth transformation signal, and γ denotes a gamma value of the pixel.

11. A display, comprising:

a plurality of pixels, each of the plurality of pixels comprising a first sub-pixel, a second sub-pixel, a third sub-pixel and a fourth sub-pixel, the pixel being used for receiving a plurality of signal values to display images, wherein the signal values are N-bit signal values, and a largest value of the signal values is $(2^N-1)$;

a signal providing device for providing a first signal, a second signal and a third signal;

a color saturation value generating device for generating a color saturation value corresponding to the first signal, the second signal and the third signal;

a signal transforming device, for transforming the first signal, the second signal and the third signal into the first output signal, the second output signal, the third output signal and the fourth output signal when the color saturation value is substantially not larger than a predetermined value; and a display panel for using the first output signal, the second output signal, the third output signal and the fourth output signal to display images corresponding to the first sub-pixel, the second sub-pixel, the third sub-pixel and the fourth sub-pixel respectively so as to form images of the pixel;

wherein the fourth output signal is not smaller than the first output signal, the second output signal and the third output signal, and N is a positive integer.

12. The display of claim 11, wherein the first predetermined value is 0.25.

13. The display of claim 11, wherein the color saturation value generating device is used to generate the color saturation value according to a ratio of a difference between a largest signal value and a smallest signal value of the first signal, the second signal and the third signal, and the largest signal value.

14. The display of claim 11, wherein the signal transforming device comprises:

a first signal transformation module, for generating a first transformation signal, a second transformation signal, a third transformation signal and a fourth transformation signal according to the first signal, the second signal and the third signal; and a second signal transformation module, for transforming the first transformation signal, second transformation signal, third transformation signal and fourth transformation signal into the first output signal, the second output signal, the third output signal and the fourth output signal.

15. The display of claim 14, wherein the second signal transformation module comprises:

a brightness value generating unit for providing a brightness value, the brightness value being a smallest value of the first transformation signal, the second transformation signal, and the third transformation signal;

a comparison value generating unit for providing a comparison value, the comparison value being a difference between the fourth transformation signal and $(2^N-1)$; and an output signal generating unit, for assigning the first output signal as a difference between the first transformation signal and the brightness value, the second output signal as a difference between the second transformation signal and the brightness value, the third output signal as a difference between the third transformation signal and the brightness value, and the fourth output signal as a sum of the fourth transformation signal and the brightness value when the brightness value is substantially not larger than the comparison value.

16. The display of claim 14, wherein the second signal transformation module comprises:

a brightness value generating unit for providing a brightness value, the brightness value being a smallest value of the first transformation signal, the second transformation signal, and the third transformation signal;

a comparison value generating unit for providing a comparison value, the comparison value being a difference between the fourth transformation signal and $(2^N-1)$; and an output signal generating unit, for assigning the first output signal as a difference between the first transformation signal and the comparison value, the second output signal as a difference between the second transformation signal and the comparison value, the third output signal as a difference between the third transformation signal and the comparison value, the fourth output signal as $(2^N-1)$ when the brightness value is substantially larger than the comparison value.

17. The display of claim 14, wherein the second signal transformation module comprises:

a brightness value generating unit for providing a brightness value, the brightness value being a gamma transformation signal of a smallest value of the first transformation signal, the second transformation signal, and the third transformation signal;

a comparison value generating unit for providing a comparison value, the comparison value being a difference between a gamma transformation signal of the fourth transformation signal and 1; and an output signal generating unit for assigning the first output signal as an inverse gamma transformation signal of a difference between a gamma transformation signal of the first transformation signal and the brightness value, the second output signal as an inverse gamma transformation signal of a difference between a gamma transformation signal of the second transformation signal and the brightness value, the third output signal as an inverse gamma transformation signal of a difference between a gamma transformation signal of the third transformation signal and the brightness value, the fourth output signal as an inverse gamma transformation signal of a sum of a gamma transformation signal of the fourth transformation signal and the brightness value when the brightness value is substantially not larger than the comparison value.

18. The display of claim 14, wherein the second signal transformation module comprises:

a brightness value generating unit for providing a brightness value, the brightness value being a gamma transformation signal of a smallest value of the first transformation signal, the second transformation signal, and the third transformation signal;

a comparison value generating unit for providing a comparison value, the comparison value being a difference between a gamma transformation signal of the fourth transformation signal and 1; and an output signal generating unit for assigning the first output signal as an inverse gamma transformation signal of a difference between a gamma transformation signal of the first transformation signal and the comparison value, the second output signal as an inverse gamma transformation signal of a difference between a gamma transformation signal of the second transformation signal and the comparison value, the third output signal as an inverse gamma transformation signal of a difference between a gamma transformation signal of the third transformation signal and the comparison value, and the fourth output signal as 1 when the brightness value is substantially larger than the comparison value.

19. The display of claim 18, wherein the gamma transformation signal of the fourth transformation signal is:

$$w = \left(\frac{W}{2^N - 1}\right)^{\gamma};$$

wherein w denotes the gamma transformation signal of the fourth transformation signal, W denotes the fourth transformation signal, and γ denotes a gamma value of the pixel.

20. The display of claim 17, wherein the gamma transformation signal of the fourth transformation signal is:

$$w = \left(\frac{W}{2^N - 1}\right)^{\gamma};$$

wherein w denotes the gamma transformation signal of the fourth transformation signal, W denotes the fourth transformation signal, and γ denotes a gamma value of the pixel.

* * * * *